US006285287B1

(12) United States Patent
Jones et al.

(10) Patent No.: US 6,285,287 B1
(45) Date of Patent: Sep. 4, 2001

(54) ALARM DEVICE

(76) Inventors: Heather Jones; Sharon Jones; Gary D. Jones, all of 3 Waterview Dr., Smithville, NJ (US) 08201

( * ) Notice: Subject to any disclaimer, the term of this patent is extended or adjusted under 35 U.S.C. 154(b) by 0 days.

(21) Appl. No.: 09/737,787

(22) Filed: Dec. 15, 2000

(51) Int. Cl.[7] ..... G08B 13/14

(52) U.S. Cl. ..... 340/573.1; 340/573.2; 340/573.3; 340/574; 340/384.2; 340/693.5

(58) Field of Search ..... 340/573.1, 693.5, 340/573.2, 573.3, 574, 384.2; 119/174, 719

(56) References Cited

U.S. PATENT DOCUMENTS

| | | | | |
|---|---|---|---|---|
| D. 374,668 | | 10/1996 | Komamiya et al. | D14/191 |
| 3,634,885 | * | 1/1972 | Barkley | 340/573.1 |
| 4,658,386 | | 4/1987 | Morris | 367/139 |
| 4,667,188 | | 5/1987 | Schwartz | 340/689 |
| 4,876,674 | * | 10/1989 | Parmely et al. | 367/139 |
| 5,001,462 | | 3/1991 | Seemann et al. | 340/574 |
| 5,006,832 | * | 4/1991 | Beaudry | 340/574 |
| 5,214,411 | | 5/1993 | Herbruck | 340/573.2 |
| 5,455,566 | * | 10/1995 | Conway | 340/573.1 |
| 5,517,180 | * | 5/1996 | Masi et al. | 340/573.1 |
| 5,551,079 | | 8/1996 | Panther et al. | 455/347 |
| 5,587,704 | * | 12/1996 | Foster | 340/573.1 |
| 5,644,296 | * | 7/1997 | Miller | 340/573.1 |
| 5,764,132 | * | 6/1998 | Hill | 340/321 |
| 5,969,593 | * | 10/1999 | Will | 340/384.2 |
| 6,097,300 | * | 8/2000 | Wei | 340/693.5 |
| 6,130,616 | * | 10/2000 | Sizemore | 340/574 |

* cited by examiner

*Primary Examiner*—Benjamin C. Lee

(57) ABSTRACT

A alarm device for warding off an imminent attack by generating loud warning sounds and generating attention. The alarm device includes a housing including a front wall, a back wall, a pair of side walls and a pair of end walls and designed for securely coupling to a user; a first sound generating device is coupled within the housing and is operationally coupled to a first such that the first sound generating device produces a first sound when the first switch is actuated; a second sound generating device is coupled within the housing operationally coupled to a second switch such that the second sound generating device produces a second sound when the second switch is actuated; and a power source is operationally coupled to the first switch and the second switch such that the power supply provides power to the first sound generating device and the second sound generating device when the first switch and the second switch are actuated.

11 Claims, 3 Drawing Sheets

ALARM DEVICE

BACKGROUND OF THE INVENTION

1. Field of the Invention

The present invention relates to personal alarms and more particularly pertains to a new alarm device for warding off an imminent attack by generating loud warning sounds and generating attention.

2. Description of the Prior Art

The use of personal alarms is known in the prior art. More specifically, personal alarms heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,214,411; U.S. Pat. No. 4,658,386; U.S. Pat. No. 4,667,188; U.S. Pat. No. 5,001,462; U.S. Pat. No. 5,551,079; and U.S. Pat. No. Des. 374,668.

While these devices fulfill their respective, particular objectives and requirements, the aforementioned patents do not disclose a new alarm device. The inventive device includes a housing including a front wall, a back wall, a pair of side walls and a pair of end walls and designed for securely coupling to a user; a first sound generating device is coupled within the housing and is operationally coupled to a first such that the first sound generating device produces a first sound when the first switch is actuated; a second sound generating device is coupled within the housing operationally coupled to a second switch such that the second sound generating device produces a second sound when the second switch is actuated; and a power source is operationally coupled to the first switch and the second switch such that the power supply provides power to the first sound generating device and the second sound generating device when the first switch and the second switch are actuated.

In these respects, the alarm device according to the present invention substantially departs from the conventional concepts and designs of the prior art, and in so doing provides an apparatus primarily developed for the purpose of warding off an imminent attack by generating loud warning sounds and generating attention.

SUMMARY OF THE INVENTION

In view of the foregoing disadvantages inherent in the known types of personal alarms now present in the prior art, the present invention provides a new alarm device construction wherein the same can be utilized for warding off an imminent attack by generating loud warning sounds and generating attention.

The general purpose of the present invention, which will be described subsequently in greater detail, is to provide a new alarm device apparatus and method which has many of the advantages of the personal alarms mentioned heretofore and many novel features that result in a new alarm device which is not anticipated, rendered obvious, suggested, or even implied by any of the prior art personal alarms, either alone or in any combination thereof.

To attain this, the present invention generally comprises a housing including a front wall, a back wall, a pair of side walls and a pair of end walls and designed for securely coupling to a user; a first sound generating device is coupled within the housing and is operationally coupled to a first such that the first sound generating device produces a first sound when the first switch is actuated; a second sound generating device is coupled within the housing operationally coupled to a second switch such that the second sound generating device produces a second sound when the second switch is actuated; and a power source is operationally coupled to the first switch and the second switch such that the power supply provides power to the first sound generating device and the second sound generating device when the first switch and the second switch are actuated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new alarm device apparatus and method which has many of the advantages of the personal alarms mentioned heretofore and many novel features that result in a new alarm device which is not anticipated, rendered obvious, suggested, or even implied by any of the prior art personal alarms, either alone or in any combination thereof.

It is another object of the present invention to provide a new alarm device which may be easily and efficiently manufactured and marketed.

It is a further object of the present invention to provide a new alarm device which is of a durable and reliable construction.

An even further object of the present invention is to provide a new alarm device which is susceptible of a low cost of manufacture with regard to both materials and labor, and which accordingly is then susceptible of low prices of sale to the consuming public, thereby making such alarm device economically available to the buying public.

Still yet another object of the present invention is to provide a new alarm device which provides in the apparatuses and methods of the prior art some of the advantages thereof, while simultaneously overcoming some of the disadvantages normally associated therewith.

Still another object of the present invention is to provide a new alarm device for warding off an imminent attack by generating loud warning sounds and generating attention.

Yet another object of the present invention is to provide a new alarm device which includes a housing including a front wall, a back wall, a pair of side walls and a pair of end walls and designed for securely coupling to a user; a first sound generating device is coupled within the housing and is operationally coupled to a first such that the first sound generating device produces a first sound when the first switch is actuated; a second sound generating device is coupled within the housing operationally coupled to a second switch such that the second sound generating device produces a second sound when the second switch is actuated; and a power source is operationally coupled to the first switch and the second switch such that the power supply provides power to the first sound generating device and the second sound generating device when the first switch and the second switch are actuated.

Still yet another object of the present invention is to provide a new alarm device that wards off attacking domestic animals such as canines through the use of sound.

Even still another object of the present invention is to provide a new alarm device that provides a warning beep if the power source is low.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
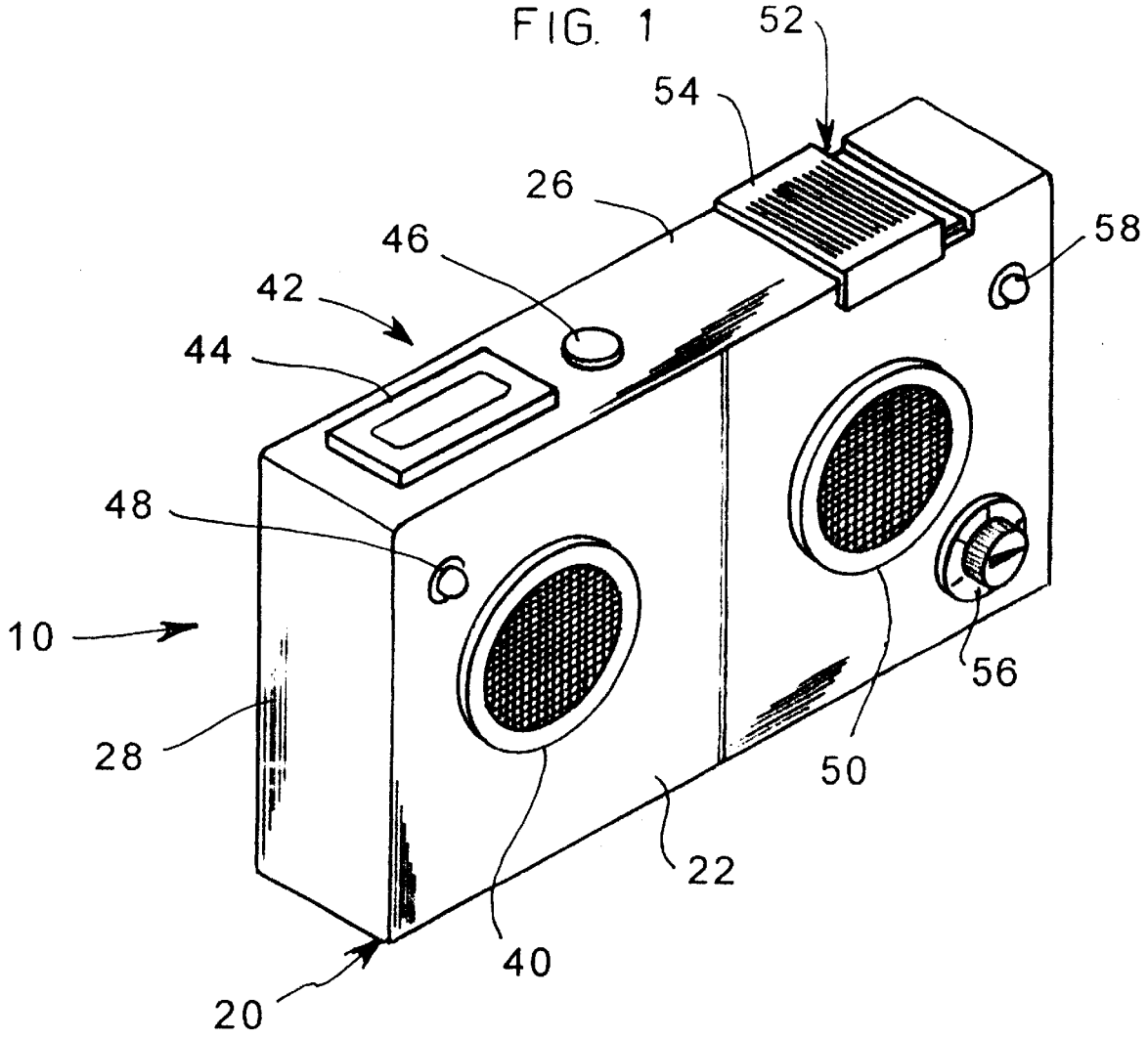
FIG. 1 is a schematic perspective view of a new alarm device according to the present invention.
Figure 2:
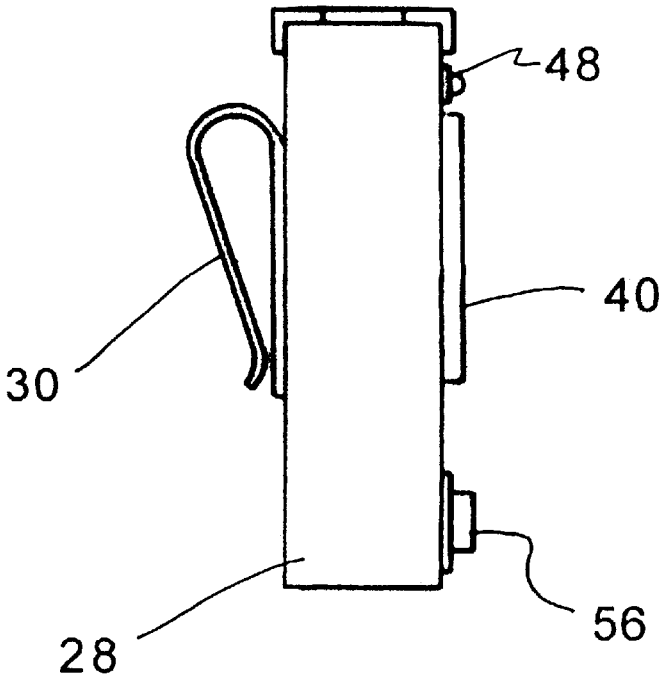
FIG. 2 is a schematic side view of the present invention.
Figure 3:
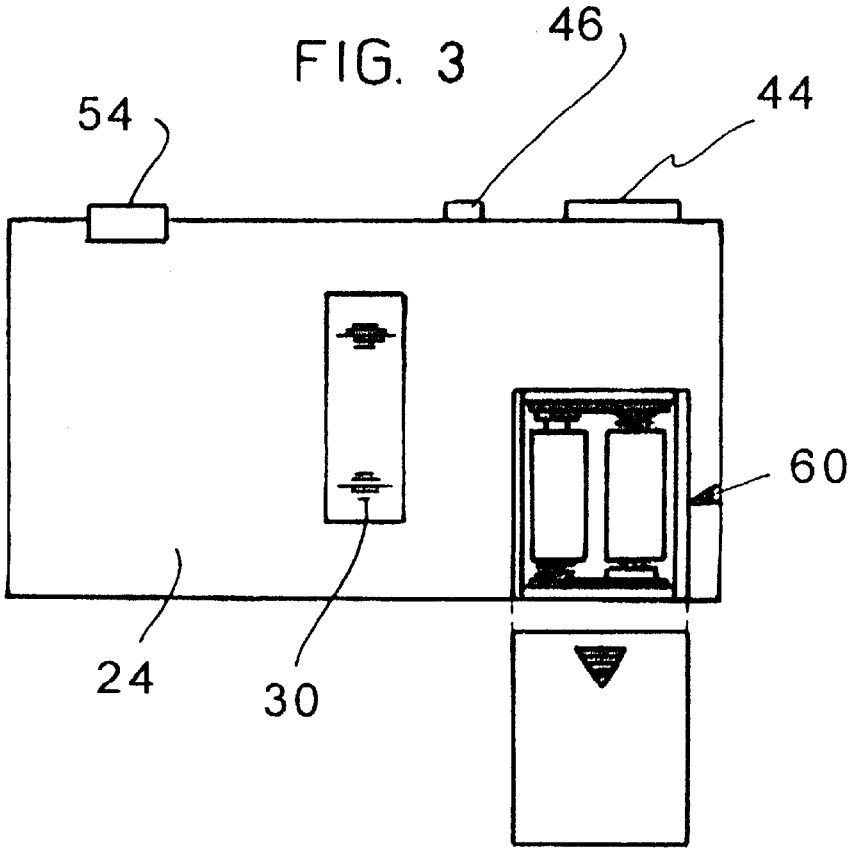
FIG. 3 is a schematic rear view of the present invention.
Figure 4:
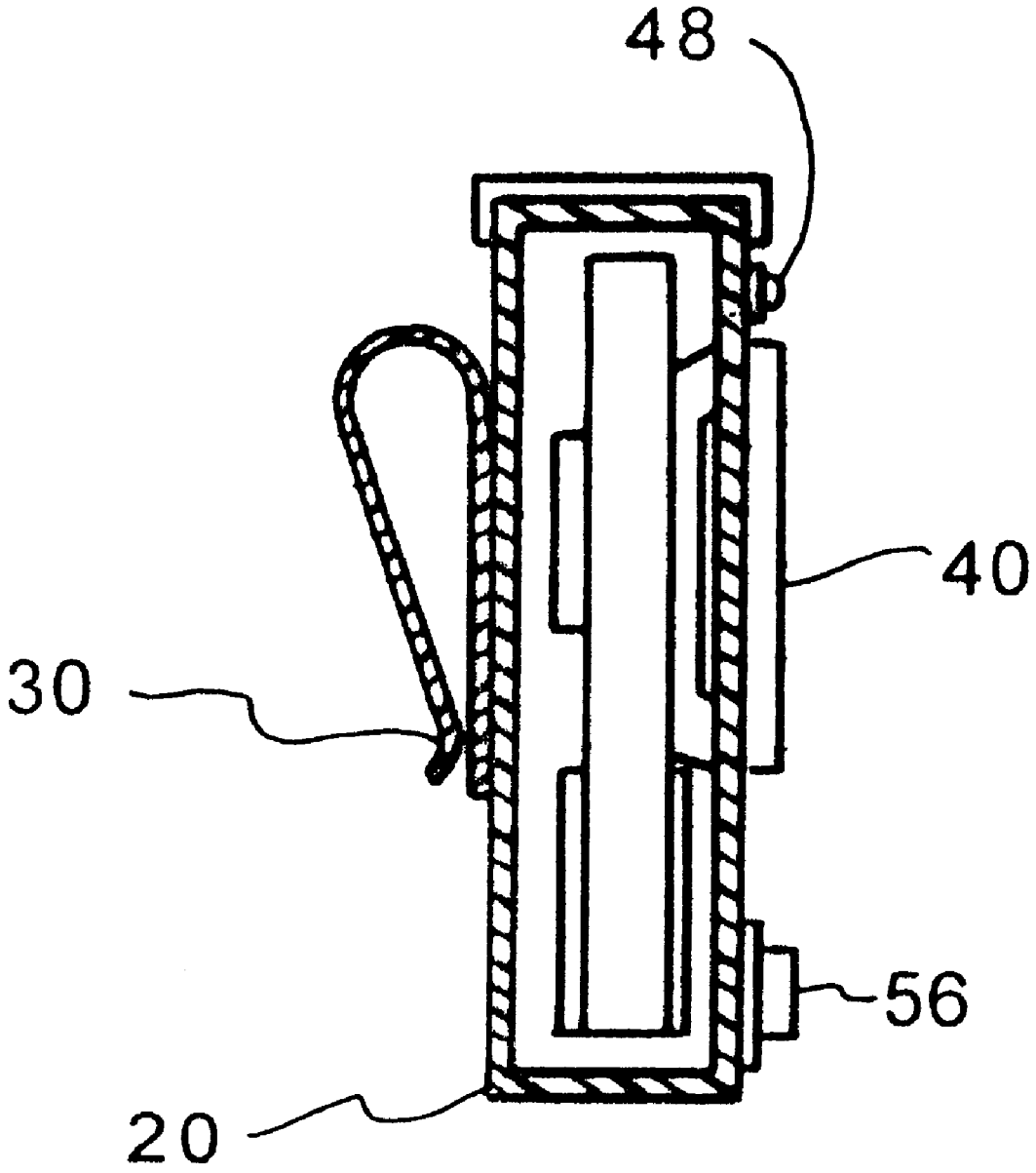
FIG. 4 is a schematic cross-sectional side view of the present invention.

With reference now to the drawings, and in particular to FIGS. 1 through 4 thereof, a new alarm device embodying the principles and concepts of the present invention and generally designated by the reference numeral 10 will be described.

As best illustrated in FIGS. 1 through 4, the alarm device 10 generally comprises a housing 20, a first 40 and second sound generating device 50, a power source 60, a first 48 and second activation light 58, a frequency dial 56, and a clip member 30.

The housing 20 includes a front wall 22, a back wall 24, a pair of side walls 26 and a pair of end walls 28. The housing 20 is designed for securely coupling to a user.

The first sound generating device 40 is coupled within the housing 20. A first switch 42 is operationally coupled to the first sound generating device 40 such that the first sound generating device 40 produces a first sound when the first switch 42 is actuated.

The second sound generating device 50 is coupled within the housing 20. A second switch 52 is operationally coupled to the second sound generating device 50 such that the second sound generating device 50 produces a second sound when the second switch 52 is actuated.

The power source 60 is operationally coupled to the first switch 42 and the second switch 52 such that the power supply 60 provides power to the first sound generating device 40 and the second sound generating device 50 when the first switch 42 and the second switch 52 are actuated.

In an embodiment the first switch 42 has a first button 44 and a second button 46. The first button 44 is for actuating the first switch 42 such that the power source 60 provides power to the first sound generating device 40. The second button 46 is for deactivating the first switch 42 such that the power supply 60 discontinues supply of power to the first sound generating device 40.

In a further embodiment the first button 44 and the second button 46 of the first switch 42 are positioned on one of the side walls 26 of the housing 20 such that the first button 44 and the second button 46 are readily accessible when the housing 20 is being worn by the user.

The first activation light 48 is operationally coupled between the first switch 42 and the first sound generating device 40 such that the first activation light 48 emits light when the first switch 42 is actuated.

The second activation light 58 is operationally coupled between the second switch 52 and the second sound generating device 50 such that the second activation light 58 emits light when the second switch 52 is actuated.

In an embodiment the second switch 52 has a slider 54, which is movable between an on position and an off position. The slider 54 in the on position actuates the switch 53 such that power is provided to the second sound generating device 50. The slider 54 in the off position deactivates the second switch 52 such that power is discontinued to the second sound generating device 50.

In a further embodiment the first sound produced by the first sound generating device 40 is a recording of a voice such that the first sound is designed for alerting pedestrians that the user is being attacked and to discourage attack.

In yet a further embodiment the second sound produced by the second sound generating device 50 is a high frequency sound. The high frequency is designed for discouraging attack by animals.

The frequency dial 56 is operationally coupled between the second switch 52 and the second sound generating device 50. The frequency dial 56 is for adjusting a frequency of the second sound generated by the second sound generating device 50.

The clip member 30 is coupled to the back wall 24 of the housing 20 such that the clip member 30 is designed for removably coupling to clothes of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An alarm device for generating a sound when a user is attacked, said alarm device comprising:

a housing having a front wall, a back wall, a pair of side walls and a pair of end walls, said housing being adapted for securely coupling to a user;

a first sound generating device being coupled within said housing, a first switch being operationally coupled to said first sound generating device such that said first sound generating device produces a first sound when said first switch is actuated;

a second sound generating device being coupled within said housing, a second switch being operationally coupled to said second sound generating device such that said second sound generating device produces a second sound when said second switch is actuated; and a power source being operationally coupled to said first switch and said second switch such that said power supply provides power to said first sound generating device and said second sound generating device when said first switch and said second switch are actuated.

2. The alarm device as set forth in claim 1, wherein said first switch has a first button and a second button, said first button being for actuating said first switch such that said power provides power to said first sound generating means, said second button being for deactivating said first switch such that said power supply discontinue supply of power to said first sound generating device.

3. The alarm device as set forth in claim 2, wherein said first button and said second button of said first switch being positioned on one of said side walls of said housing such that said first button and said second button are readily accessible when said housing is being worn by the user.

4. The alarm device as set forth in claim 1, further comprising:

a first activation light being operationally coupled between said first switch and said first sound generating device such that said first activation light emits light when said first switch is actuated.

5. The alarm device as set forth in claim 4, further comprising:

a second activation light being operationally coupled between said second switch and said second sound generating device such that said second activation light emits light when said second switch is actuated.

6. The alarm device as set forth in claim 1, wherein said second switch has a slider movable between an on position and an off position, said slider in said on position actuates said switch such that power is provided to said second sound generating device, said slider in said off position deactivates said second switch such that power is discontinued to said second sound generating device.

7. The alarm device as set forth in claim 1, wherein said first sound produced by said first sound generating device is a recording of a voice such that said first sound is adapted for alerting pedestrians that the user is being attacked and to discourage attack.

8. The alarm device as set forth in claim 1, wherein said second sound produced by said second sound generating device is a high frequency sound, said high frequency being adapted for discouraging attack by animals.

9. The alarm device as set forth in claim 8, further comprising:

a frequency dial being operationally coupled between said second switch and said second sound generating device, said frequency dial being for adjusting a frequency of said second sound generated by said second sound generating device.

10. The alarm device as set forth in claim 1, further comprising:

a clip member being coupled to said back wall of said housing such that said clip member is adapted for removably coupling to clothes of the user.

11. An alarm device for generating a sound when a user is attacked, said alarm device comprising:

a housing having a front wall, a back wall, a pair of side walls and a pair of end walls, said housing being adapted for securely coupling to a user;

a first sound generating device being coupled within said housing, a first switch being operationally coupled to said first sound generating device such that said first sound generating device produces a first sound when said first switch is actuated;

a second sound generating device being coupled within said housing, a second switch being operationally coupled to said second sound generating device such that said second sound generating device produces a second sound when said second switch is actuated;

a power source being operationally coupled to said first switch and said second switch such that said power supply provides power to said first sound generating device and said second sound generating device when said first switch and said second switch are actuated;

wherein said first switch has a first button and a second button, said first button being for actuating said first switch such that said power provides power to said first sound generating means, said second button being for deactivating said first switch such that said power supply discontinue supply of power to said first sound generating device;

wherein said first button and said second button of said first switch being positioned on one of said side walls of said housing such that said first button and said second button are readily accessible when said housing is being worn by the user;

a first activation light being operationally coupled between said first switch and said first sound generating device such that said first activation light emits light when said first switch is actuated;

a second activation light being operationally coupled between said second switch and said second sound generating device such that said second activation light emits light when said second switch is actuated;

wherein said second switch has a slider movable between an on position and an off position, said slider in said on position actuates said switch such that power is provided to said second sound generating device, said slider in said off position deactivates said second switch such that power is discontinued to said second sound generating device;

wherein said first sound produced by said first sound generating device is a recording of a voice such that said first sound is adapted for alerting pedestrians that the user is being attacked and to discourage attack;

wherein said second sound produced by said second sound generating device is a high frequency sound, said high frequency being adapted for discouraging attack by animals;

a frequency dial being operationally coupled between said second switch and said second sound generating device, said frequency dial being for adjusting a frequency of said second sound generated by said second sound generating device; and a clip member being coupled to said back wall of said housing such that said clip member is adapted for removably coupling to clothes of the user.

* * * * *